United States Patent [19]

Uyehara

[11] 4,347,503

[45] Aug. 31, 1982

[54] BEDWETTING DETECTION DEVICE

[75] Inventor: Otto A. Uyehara, Madison, Wis.

[73] Assignee: Health Guardian Company, Monroe, Wis.

[21] Appl. No.: 234,825

[22] Filed: Feb. 17, 1981

[51] Int. Cl.[3] ..... G08B 21/00

[52] U.S. Cl. ..... 340/604; 73/304 R; 324/65 R; 340/62 D

[58] Field of Search ..... 340/602, 604, 620, 618; 73/304 R, 304 C; 324/61 R, 61 P, 65 R

[56] References Cited

U.S. PATENT DOCUMENTS

| | | | |
|---|---|---|---|
| 2,726,294 | 12/1955 | Kroening et al. | 340/604 X |
| 3,460,136 | 8/1969 | Jambazian | 340/384 E |
| 3,475,746 | 10/1969 | Nelson et al. | 340/566 |
| 3,818,468 | 6/1974 | Toth et al. | 340/602 X |
| 3,821,699 | 6/1974 | Marus et al. | 340/620 |
| 3,944,845 | 3/1976 | Luteran | 340/620 X |

*Primary Examiner*—John W. Caldwell, Sr.
*Assistant Examiner*—Daniel Myer
*Attorney, Agent, or Firm*—Isaksen, Lathrop, Esch, Hart & Clark

[57] ABSTRACT

An improved bedwetting detection device is responsive to moisture in the bed of the user to create an alarm when bedwetting occurs. The device includes controlling circuitry connected to metallic conductors (12, 14) installed in the bed of the user. The circuitry periodically provides electrical pulses to the conductors (12, 14) so as to minimize the introduction of electrical impulses into the bed of the user. Furthermore, the pulse created by the circuitry is of a very low voltage so as to further minimize the amount of electrical energy introduced into the bed of the user.

7 Claims, 2 Drawing Figures

BEDWETTING DETECTION DEVICE

BACKGROUND OF THE INVENTION

1. Field of the Invention

The present invention relates to devices to be installed in the beds of children having a problem with bedwetting so as to awaken them upon the occurrence of nocturnal urination.

2. Description of the Prior Art

The prior art is generally cognizant of the use of alarms responsive to moisture in a bed for creating an audible alarm signal to wake up an individual sleeping in the bed. Such devices are conventionally used with children having a problem with bedwetting so as to awaken them when nocturnal urination occurs. One such device is disclosed in U.S. Pat. No. 2,726,294 to Kroening, et al., assigned to the assignee of the present invention. The present invention is intended to be an improvement upon said device. Other devices for similar installation in the bed of a user are shown in U.S. Pat. Nos. 2,668,202 and 3,441,109. Other moisture sensitive or bodily waste detection devices are shown in U.S. Pat. Nos. 3,530,855, 4,069,817, 4,162,490, 4,178,589, and 4,205,672.

SUMMARY OF THE INVENTION

The present invention is summarized in that an improved battery-operated detector includes a pair of conductors adapted to being installed in the bed of the user; a moisture-sensitive insulator adapted for placement between the conductors; an electric current detecting circuit connected to a first of the conductors to detect current flow therethrough; an alarm connected to the detector system to awaken the user when the detector circuit senses current flow; and a periodic pulse generating circuit connected to the second of the conductors to periodically generate an electrical pulse on said second of the conductors so as to cause current to flow through the first conductor if the insulator is damp.

It is an object of the present invention to provide an improved bedwetting detection circuit which only periodically applies electrical energy to the detecting conductors installed in the bed of the user.

It is another object of the present invention to provide a bedwetting detection circuit which applies the minimum voltage of electricity, preferably less than the electrolysis voltage of water, to the bed of the user.

Another object of the present invention is to provide such a bedwetting detection circuit which is efficient in its operation and economical to manufacture.

Other objects, advantages and features of the present invention will become apparent from the following specification when taken in conjunction with the accompanying drawings.

DESCRIPTION OF THE PREFERRED EMBODIMENT

Figure 1:
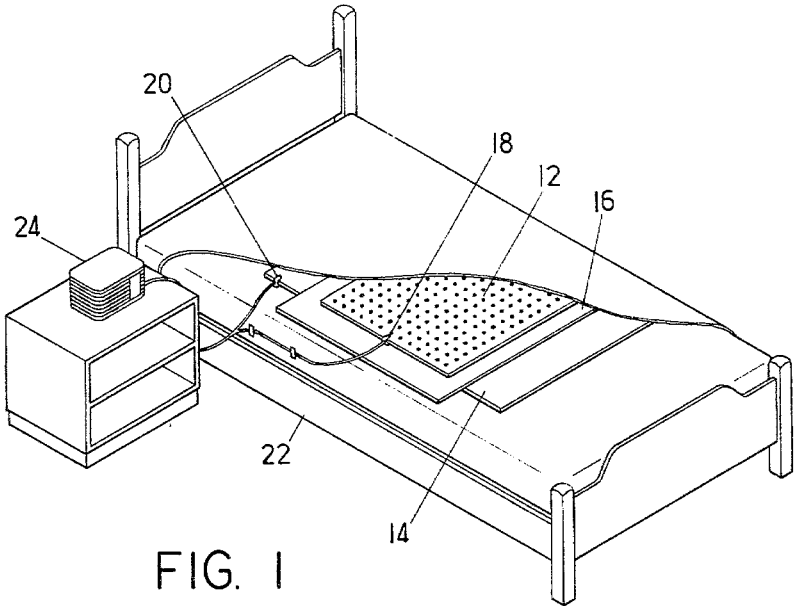
FIG. 1 is a schematic diagram of a bedwetting detection device constructed in accordance with the present invention.

Shown in FIG. 1 installed in a bed is a bedwetting apparatus constructed in accordance with the present invention. Made into the bed of the user are a pair of conductors in the form of metallic foil sheets 12 and 14 which are separated by an insulator in the form of a spacer 16 which is large enough to completely separate the two conductors 12 and 14. The conductors 12 and 14 may be constructed of metallic foil or other conductive material alone, or may be constructed of laminates of conductive foil onto other materials if so desired. The conductors 12 and 14 may also be manufactured as a sheet printed circuit with an insulating section 16 provided between the conductors 12 and 14. The upper conductor 12 is provided with a plurality of perforations so that moisture can pass therethrough, while the lower sheet conductor 14 is solid. The insulator sheet 16 is of sufficient dimension so as to completely separate the two conductors 12 and 14 electrically from each other when dry. The insulator 16 is also moisture-permeable in the sense that urine or other salt carrying fluid can permeate the insulator 16 to thereby make it electrically conductive. A pair of clips 18 and 20 are connected to the respective conductors 12 and 14 so that suitable wiring 22 can connect the conductors 12 and 14 to a control unit 24.

Figure 2:
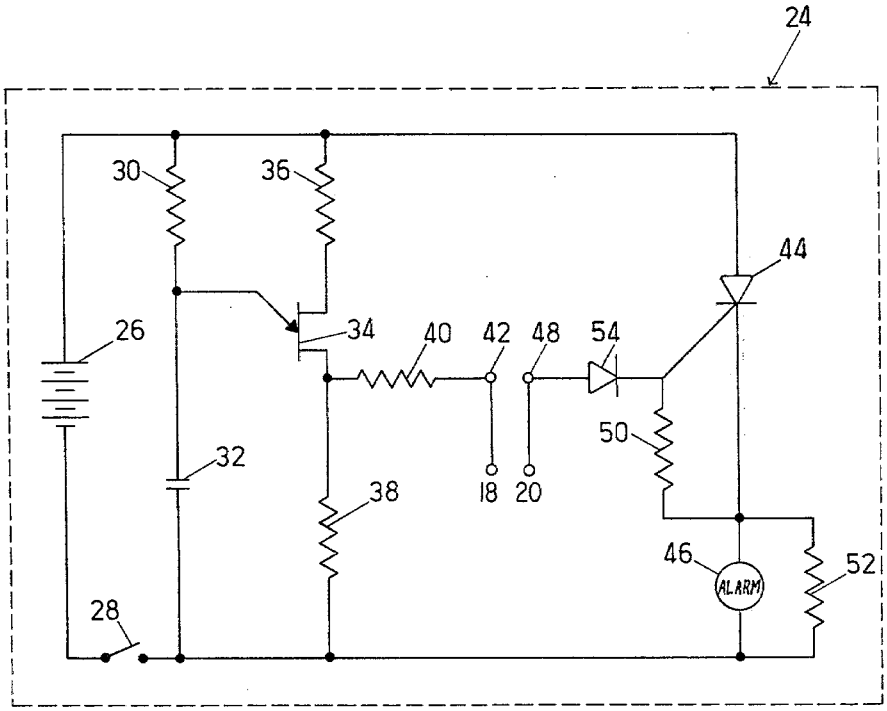
FIG. 2 is a schematic circuit diagram of the controller of the bedwetting detection device of FIG. 1.

Shown in FIG. 2 are the details of construction of the circuitry within the control unit 24. The control unit 24 is provided with a small, dry-cell battery 26 therein. The battery 26, preferably a conventional six-volt, dry-cell flashlight battery, is of a type regularly commercially available. An off-on switch 28 is provided attached to the negative terminal of the battery so as to impose and remove power from the circuit when so desired. A resistor 30 and a capacitor 32 are arranged in series between the positive and negative terminals of the battery 26 to form an RC timing circuit. The junction of the resistor 30 and the capacitor 32 is connected to the emitter terminal of a unijunction transistor (UJT) 34. The base-two terminal of the UJT 34 is connected through a resistor 36 to the positive side of the battery 26, while the base-one terminal of the UJT 34 is connected through another resistor 38 and the switch 28 to the negative terminal of the battery 26. The resistors 36 and 38 are selected so as to function as a fixed voltage divider, as will be discussed in greater detail below. The junction of the base-one terminal of the UJT 34 and the resistor 38 are connected by a resistor 40 to a circuit output terminal 42.

Also connected as a series circuit between the positive and negative terminals of the battery 26 is a series circuit consisting of a silicon-controlled rectifier (SCR) 44 and a buzzer 46. The SCR 44 has its anode connected to the positive side of the battery 26, while its cathode is connected to one side of the buzzer 46, the other side of which is connected through the switch 28 to the negative side of the battery 26. The gate terminal of the SCR 44 is connected to the cathode of a diode 54, the anode of which is connected to a second circuit output terminal 48. The junction of the cathode of the diode 54 and the gate terminal of the SCR 44 is connected through a resistor 50 to the junction of the cathode of the SCR 44 and the buzzer 46. A latching resistor 52 is connected in parallel across the buzzer 46. The circuit output terminals 42 and 48 are connected by the wiring 22 to the respective conductors 12 and 14 to complete the installation of the apparatus according to the present invention.

In its operation, the bedwetting detection apparatus of FIGS. 1 and 2 functions to periodically monitor the moisture level in the insulator 16 between the two conductors 12 and 14 installed in the bed of the user so as to determine whether bedwetting has occurred. This sensing function is accomplished through the periodic pulsing of very low levels of electrical energy to the conductors with the energy being kept as low as practicable in order to prevent any sensing of the electrical charge by the user and to completely prevent any possibility of any harm to the user. The voltage of the electric pulse is also kept below the electrolysis voltage of water, about 1.5 volts, to prevent the generation of any free gasses. Within the circuitry of FIG. 2, the resistor 30 and the capacitor 32, together with the UJT 34 and the resistors 36, 38 and 40, function as a pulse generating circuit to periodically generate electrical pulses of very low energy. The series circuit of the SCR 44 and the buzzer 46, together with the diode 54 and the resistors 50 and 52, functions as a current flow detector and alarm generator to detect current flow caused by the pulses and to trigger an audible, or other type, alarm if current flow, and thereby dampness, is detected.

In the details of the circuitry within the controller 24, the resistor 30 and capacitor 32 function as an RC timing circuit which, after a discharge of the capacitor 32, provides a slowly rising voltage at the junction of the resistor 30 and the capacitor 32. This slowly rising voltage is imposed upon the emitter of the UJT 34 and periodically triggers the UJT 34 into conduction. The voltage at the two base terminals of the UJT 34 is determined by the resistance differential between the two voltage dividing resistors 36 and 38 which are connected in series. When the UJT 34 is triggered into conduction, the capacitor 32 is discharged through the resistor 38 and through the resistor 40 to the circuit output terminal 42 which is, in turn, connected to the conductor 12 in the bed. If the bed of the user is dry, no current flows between the circuit output terminals 42 and 48 since no current can flow between the conductors 12 and 14. Thereafter, the UJT 34 completely discharges the capacitor 32, after which the UJT 34 turns off, and the capacitor begins to charge again to repeat the cycle. The values of the resistor 30 and the capacitor 32 determine the time period of this periodic pulsing of the conductors 12 and 14, since these values control the charge rate of the capacitor 32.

If, on the other hand, moisture is present in the insulator sheet 16 in the bed of the user, electrical current can flow from a one of the conductors 12 and 14 to the other. If such moisture is present when the UJT 34 begins to conduct, current can pass through the circuit output terminal 42, between the conductors 12 and 14 and then through the diode 46 to the current sensing circuit constructed around the SCR 44. Current flowing into the gate terminal of the SCR 44 causes the SCR 44 to trigger into conduction, thereby allowing current to flow between the anode and cathode. This current flowing through the SCR 44 flows also through the buzzer 46, creating an audible alarm intended to arouse the occupant of the bed in which the sheets 12 and 14 are installed. The buzzer 46 remains energized, creating the alarm, until the user awakens and turns off the device by flipping the switch 28. The resistor 50 functions to insure that the SCR 44 is biased to turn on properly, while the resistor 52 is provided to serve as a latch to keep the SCR 44 in conduction. Since the SCR 44 must continuously conduct to remain in conduction, and since the buzzer 46 conducts only intermittently, the resistor 52 serves to maintain current flow through the SCR 44 to keep the buzzer 46 energized until the switch 28 is opened. The diode 54 serves to prevent any reverse current flow to the conductors 12 and 14 by preventing current flow from the SCR 44 to the conductors 12 and 14.

The device of the present invention, as described in FIGS. 1 and 2, includes advantageous features specifically designed for energy conservation to prolong the life of the battery 26 and for complete and absolute safety of the occupant of the bed in which the device is installed. Thus, by selecting a large RC time constant for the resistor 30 and the capacitor 32, it is possible to select a relatively long time between triggerings of the UJT 34 so that only periodic pulsing, with pulses of very short duration, of the conductors 12 and 14 in the bed occurs. Thus it is preferred that the resistance and capacitance of the resistor 30 and the capacitor 32 respectively be selected in conjunction with the characteristics of the UJT 34 to give a time period between pulses of between 5 and 10 seconds. Since the UJT 34 will remain conductive for only a short period of time, typically in the micro-second range, the electrical pulse is applied to the conductors 12 and 14 for only a very small percentage of the time. Obviously, the values of the resistor 30 and the capacitor 32 may be varied as may be desired to obtain any desired time period for the periodic pulsing of the UJT 34. Clearly, the fact that the circuit of FIG. 2 generates only occasional very short pulses would indicate that not only is a minimum amount of electricity introduced into the bed of the user, but the power drain on the battery 26 would be minimized.

The provision for the voltage dividing resistances 36 and 38 also provides another degree of safety in the apparatus as constructed in accordance with the present invention. It is intended that the resistance of the resistor 36 be selected so as to be much greater than the resistance of the resistor 38. By "much greater than", as used herein, it is intended to state that the resistance of the resistor 36 is at least ten times greater than that of the resistor 38 and is preferably approximately fifty times greater. The reason for this differential between the resistances of the resistors 35 and 38 is to limit the voltage which can be applied through the output junctions 42 and 48 to the conductors 12 and 14. During the conduction of the UJT 34, the resistors 36 and 38 are, in effect, connected in parallel across the battery 26. By providing that the resistance of the resistor 36 is at least ten times greater than that of the resistor 38, these resistors ensure that the value of the voltage applied through the resistor 40 to the conductors is no greater than one tenth of the voltage of the battery 26. Since the battery 26 is a six-volt battery, the absolute maximum voltage which can be applied through the output junction 42 to the conductors 12 and 14 in the bed of the user is approximately 0.6 volts, with the actual voltage likely to be much less. In any event, it is intended and preferred that the voltage of the pulse be less than the electrolysis voltage of water, which is approximately 1.5 volts. By keeping the pulse below this level, it is insured that no free gasses are generated by the electrical pulse, which gasses might affect some highly sensitive individuals. Furthermore, since the voltage pulse generated by the circuit would rise and then fall again very quickly, its effect would be similar to an AC signal, and it would quickly cancel out any electrolysis effects the pulse might otherwise have. The output junction 48 remains at approximately zero potential, since it is connected to ground through the resistors 50 and 52, until a damp insulator 16 allows current to pass to it from output junction 42. In this fashion, it is virtually impossible for any physiological effect to be created by the electricity passing between the conductors 12 and 14 because of its extremely low voltage.

Thus the apparatus of the present invention functions both as an energy conservation improvement over previously known devices of this type and also functions to achieve the maximum level of protection for the user, a result which was heretofore not possible in the art. A combination of the periodic character of the timing pulse applied to the conductors 12 and 14 and the very low level of the voltage applied thereby insures that little or no voltage is used by the circuit so as to maintain the life of the battery 26, while also insuring that a minimum amount of electrical energy is introduced into the bed of the user. In this fashion, a more energy efficient and safer device is created than was heretofore possible in the prior art.

It is understood that the present invention is not limited to the particular construction and arrangement of parts disclosed and illustrated herein, but embraces all such modified forms thereof as come within the scope of the following claims.

I claim:

1. A battery-operated bedwetting detector comprising a pair of conductors (12, 14) adapted to being installed in the bed of the user;

a moisture-permeable insulator (16) adapted for placement between the conductors (12, 14);

an electric current detector circuit (44, 50, 52, 54) connected to a first of the conductors (12, 14) to detect current flow therethrough;

an alarm (46) connected to the detector circuit to awaken the user when the detector circuit senses current flow;

a periodic pulse generating circuit (30, 32, 34, 36, 38, 40) connected to the second of the conductors (12, 14) to periodically generate an electrical pulse on the second of the conductors (12, 14) so as to cause current to flow through the first conductor if the insulator (16) is damp; and a voltage divider (36, 38) in the pulse generating circuit connected so that the voltage of the pulse created by the pulsing circuit is less than the electrolysis voltage of water.

2. A bedwetting detector as claimed in claim 1 wherein the voltage divider (36, 38) is formed of resistors (36, 38) which have values selected so that the voltage of the pulse generated by the pulse generating circuit is no more than one volt.

3. A bedwetting detector as claimed in claim 1 wherein the current detector circuit (44, 50, 52, 54) includes a silicon-controlled rectifier (44) which is triggered by current flow between the two conductors (12, 14).

4. A bedwetting detector as claimed in claim 3 wherein the alarm (46) is an audible alarm and is connected in series with the silicon-controlled rectifier (44) and a resistor (52) is connected in parallel across the audible alarm (46) to maintain continuous current flow through the silicon-controlled rectifier.

5. A bedwetting detector as claimed in claim 1 wherein the pulse generating circuit (30, 32, 34, 36, 38, 40) includes an RC timing circuit (30, 32) and a unijunction transistor (34) with the RC timing circuit (30, 32) connected to trigger, and to be discharged through, the unijunction transistor (34).

6. A bedwetting detector as claimed in claim 5 wherein the values of the elements of the RC timing circuit (30, 32) are selected so that a pulse is generated by the pulse generating circuit no more often than once every five seconds.

7. A method of detecting bedwetting comprising the steps of installing a pair of conductors (12, 14) in the bed of a user which are separated by a moisture-permeable insulator (16);

periodically generating an electric pulse which is formed from a divided portion of the supply voltage so that the voltage of the electric pulse is limited to less than the electrolysis voltage of water, and transmitting the electric pulse to a first of the conductors (12, 14);

continually electrically sensing the second of the conductors to detect electric current flow between the conductors (12, 14) so that such current flow will be detected if the insulator (16) is damp; and generating an alarm (46) to awaken the user if electric current flow between the conductors (12, 14) is detected.

* * * * *